US007300277B2

(12) United States Patent
Foos et al.

(10) Patent No.: US 7,300,277 B2
(45) Date of Patent: Nov. 27, 2007

(54) TORCH OPERABLE TO POSITION A FLOW CONTROL LEVER AT A PLURALITY OF LOCATIONS ON THE TORCH

(75) Inventors: Gary A. Foos, Watertown, SD (US); Robert W. Wakeman, Watertown, SD (US); Bruce A. Buhler, Watertown, SD (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/679,043

(22) Filed: Oct. 3, 2003

(65) Prior Publication Data

US 2005/0074715 A1 Apr. 7, 2005

(51) Int. Cl.

| | |
|---|---|
| ***F23D 14/38*** | (2006.01) |
| ***F23D 14/46*** | (2006.01) |
| ***F16K 27/04*** | (2006.01) |
| ***F16K 31/44*** | (2006.01) |

(52) U.S. Cl. ..... 431/345; 266/48; 137/625.17; 137/270; 239/414; 251/231

(58) Field of Classification Search ..... 431/345, 431/344, 127, 128, 91, 258, 278, 154; 266/77, 266/48; 137/625.17, 270; 251/231, 319; 239/414; 173/169

See application file for complete search history.

(56) References Cited

U.S. PATENT DOCUMENTS

| | | | | |
|---|---|---|---|---|
| 2,275,491 | A * | 3/1942 | Barna | 431/345 |
| 2,666,479 | A * | 1/1954 | Clinton, Jr. | 251/237 |
| 2,672,186 | A * | 3/1954 | Smith | 431/345 |
| 2,709,446 | A * | 5/1955 | Miller | 137/270 |
| 2,893,420 | A * | 7/1959 | Steventon | 137/271 |
| 3,891,195 | A * | 6/1975 | Mills et al. | 266/48 |
| 5,470,227 | A * | 11/1995 | Mims et al. | 431/345 |
| 5,571,427 | A * | 11/1996 | Dimock et al. | 219/75 |

FOREIGN PATENT DOCUMENTS

| | | | |
|---|---|---|---|
| DE | 2101127 | A * | 7/1971 |

* cited by examiner

*Primary Examiner*—Josiah C. Cocks
(74) *Attorney, Agent, or Firm*—Fletcher Yoder

(57) ABSTRACT

A torch operable to pivotally secure a lever on opposite sides of the torch. The torch may comprise a torch butt, a valve assembly, and a lever. The valve assembly may be operable to control a flow of a fluid through the torch butt. The lever may be selectively securable to a first portion of the torch butt and a second portion of the torch butt. The second portion of the torch butt may be disposed opposite the first portion of the torch butt. The valve assembly may be selectively securable within the torch butt to enable the lever to operate the valve assembly with the lever selected to pivot about the first portion of the torch butt and the second portion of the torch butt.

29 Claims, 9 Drawing Sheets

TORCH OPERABLE TO POSITION A FLOW CONTROL LEVER AT A PLURALITY OF LOCATIONS ON THE TORCH

BACKGROUND OF THE INVENTION

1. Field of the Invention

The present invention relates generally to the field of cutting torches. More particularly, the invention relates to a technique for enabling a cutting torch to have a cutting oxygen lever that is may be positioned on a plurality of locations of the cutting torch.

2. Description of the Related Art

A cutting torch may be used to produce a flame to cut through a material. A typical torch system utilizes a flammable fuel and oxygen to produce the flame. The torch is supplied with pressurized fuel and oxygen. The typical cutting torch has a first throttle valve to reduce the pressure of the fuel flowing through the torch and a second throttle valve to reduce the pressure of the oxygen flowing through the torch. These two flows are mixed in or immediately after a cutting tip of the torch. This fuel and oxygen mixture is ignited to produce a flame at the cutting tip. This flame is known as the preheat flame and serves to warm the metal to a point just below the melting point of the metal to be cut.

In addition, the typical cutting torch is adapted to direct a flow of high pressure oxygen to the flame, bypassing the second throttle valve. This flow of oxygen is known as cutting oxygen. When the cutting oxygen flows to the flame, the temperature of the flame, and the metal, is taken quickly past the melting point of the metal. In addition, the force of the cutting oxygen carries the products of the cutting flame through the metal, facilitating the melting or even burning of the metal.

A typical cutting torch has a lever that is coupled to a cutting oxygen valve to control the flow of cutting oxygen through the torch. The lever typically is oriented such that the operator may hold the cutting torch and operate the lever with the same hand. Typically, the lever is pivoted towards the handle in a short arcing motion to open the cutting oxygen valve.

For ergonomic reasons, a torch may be designed to position the lever on the top of the torch or on the bottom of the torch. However, current designs utilize different components for each of these orientations of the lever. Thus, the same components cannot be used to assemble a torch with either lever configuration. This increases the overall cost of manufacturing both configurations of cutting torch. In addition, at some point in time a user may desire to reposition the lever from its original position. However, this may be impracticable if additional parts are needed to reposition the cutting oxygen lever on the torch.

There is a need therefore for a torch that enables the cutting oxygen lever to be positioned at different positions on the torch with the same parts. In addition, there is a need for a torch that enables a user to quickly and easily move the cutting oxygen lever from one location to another on the torch. In addition, there is a need for a torch handle with better ergonomic characteristics.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
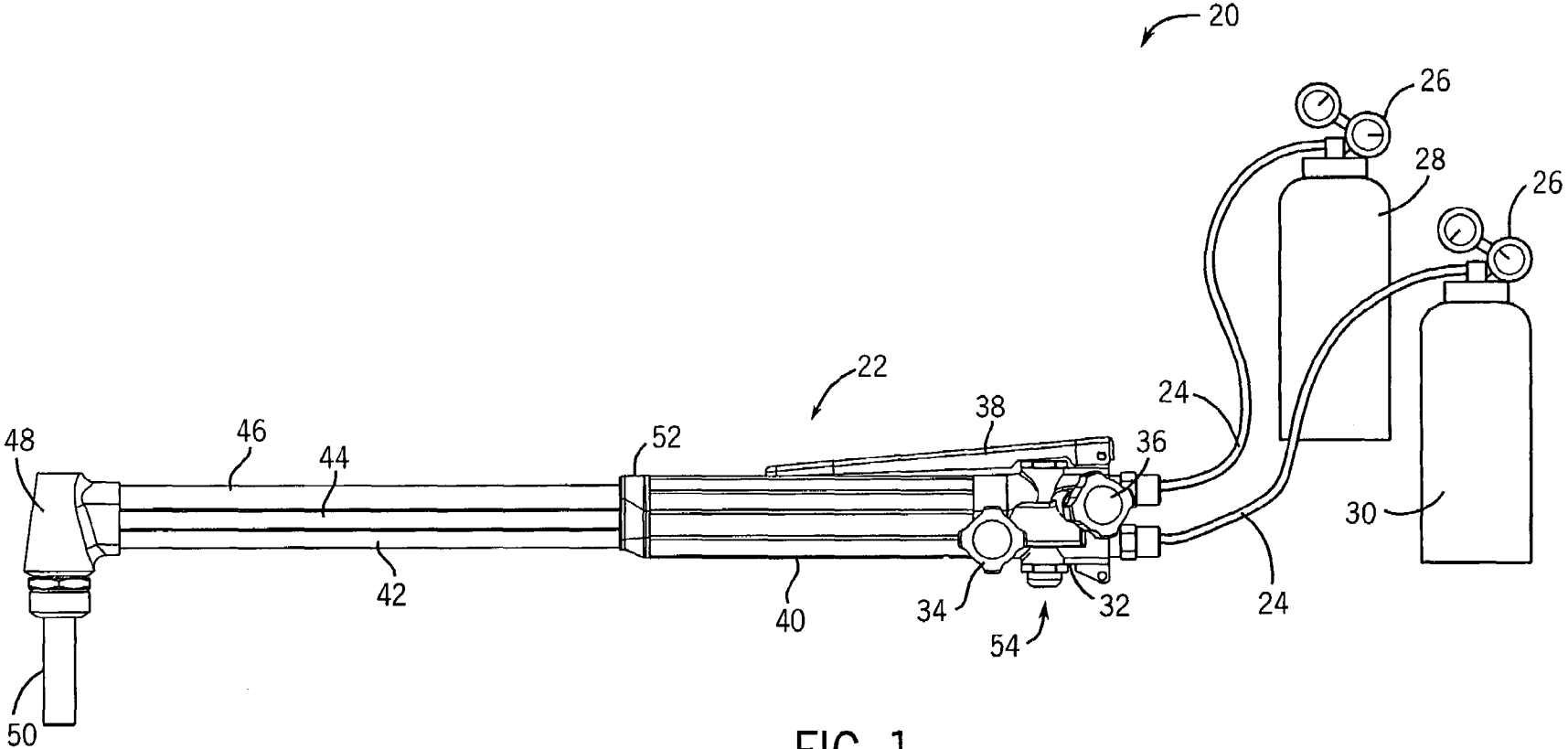
FIG. 1 is a perspective view of a torch system, in accordance with an exemplary embodiment of the present invention.

Referring generally to FIG. 1, a cutting torch system 20 is illustrated. In the illustrated embodiment, a cutting torch 22 is coupled to a pair of hoses 24, which are coupled to a pair of pressure regulators 26 coupled to an oxygen source 28 and a fuel source 30. However, the torch system 20 may take various alternate forms. For example, in the illustrated embodiment, the oxygen source 28 and fuel source 30 are gas cylinders. However, an installed gas system may be used. In addition, the fuel may be a gas or a liquid. For example, the fuel may be oxy-acetylene, propane, butane, manufactured gas, etc. Similarly, an oxidizer other than oxygen may be used.

Figure 2:
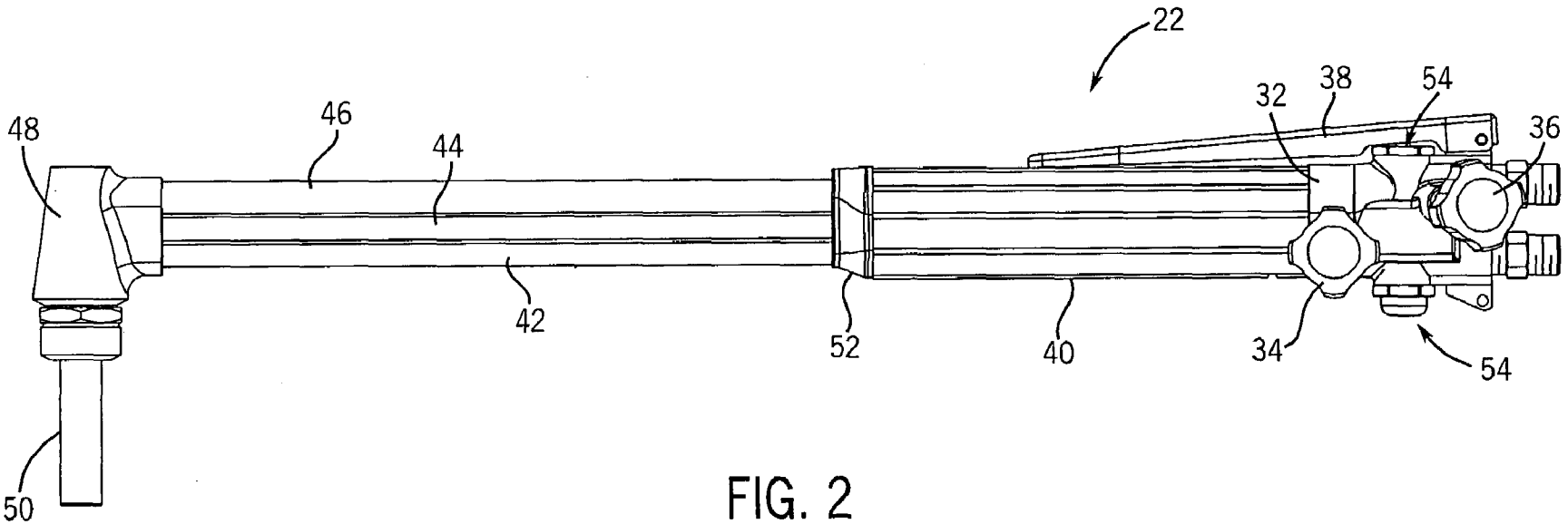
FIG. 2 is an elevation view of the torch of FIG. 1, with a control lever disposed in a first orientation relative to the torch.
Figure 3:
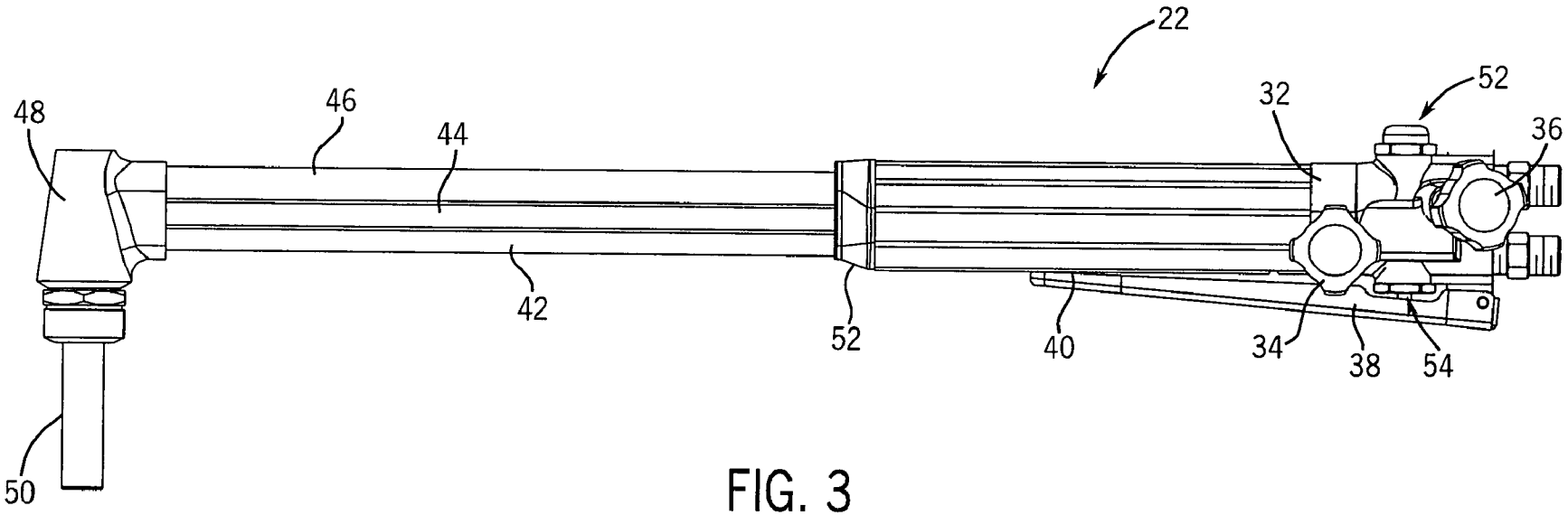
FIG. 3 is an elevation view of the torch of FIG. 1 with the control lever disposed in a second orientation relative to the torch.

Referring generally to FIGS. 1-3, an exemplary embodiment of a cutting torch 22 is illustrated. The illustrated torch 22 is operable to receive pressurized fuel and oxygen from the oxygen cylinder 28 and the fuel cylinder 30 and produce a flow of fuel, a flow of pre-heat oxygen, and a flow of cutting oxygen from the torch 22. In the illustrated embodiment, the torch 22 comprises a torch butt 32 that is coupled to the pair of hoses 24 to receive pressurized oxygen from the oxygen cylinder 28 and fuel from the fuel cylinder 30. The torch butt 32 has a fuel valve assembly 34 that is operable to throttle the flow of fuel flowing from the fuel cylinder 30. In addition, the torch butt 32 has a preheat oxygen valve assembly 36 that is operable to throttle the flow of oxygen flowing from the oxygen cylinder 28 to produce the flow of pre-heat oxygen.

The torch butt 32 also comprises a cutting oxygen lever 38 that is operable to control a second flow of pressurized oxygen, the cutting oxygen. The cutting oxygen bypasses the pre-heat oxygen valve assembly 36 so that the flow of cutting oxygen is at a higher pressure than the pre-heat oxygen. The illustrated embodiment of the torch 22 enables the cutting oxygen lever 38 to be selectively positioned on either the top or the bottom of the torch 22. In addition, the same components are used to assemble the torch 22 in each configuration of the torch 22.

A handle 40 is provided to enable a user to grip the torch 22. The handle 40 is disposed over one end of the torch butt 32. In the illustrated embodiment, the handle 40 also is disposed over a fuel tube 42, a pre-heat oxygen tube 44, and a cutting oxygen tube 46 that extend from the torch butt 32 to a torch head 48. The torch head 48 merges the flows of fuel and oxygen and directs the merged flow of fuel and oxygen to a cutting tip 50. The cutting tip 50 directs the fuel and oxygen towards a cutting surface and is adapted to produce a desired flame characteristic for cutting. A tube support 52 is provided to support the fuel tube 42, the preheat oxygen tube 44, and the cutting oxygen tube 46. The tube support 52 is disposed within one end of the handle 40 in the illustrated embodiment.

As noted above, the torch 22 is adapted to enable the cutting oxygen lever 38 to be selectively disposed on the top of the torch butt 32 or the bottom of the torch butt 32 with the same components. In FIG. 2, the cutting oxygen lever 38 is secured to the top of the torch butt 32. In FIG. 3, the cutting oxygen lever 38 is secured to bottom of the torch butt 32. In the illustrated embodiment, a cutting oxygen valve assembly 54 is disposed within the torch butt 32. The cutting oxygen valve assembly 54 is an isolation valve assembly that cooperates with the cutting torch butt 32 to control the flow of cutting oxygen through the torch butt 32. The cutting oxygen lever 38 enables a user to open and close the cutting oxygen valve assembly 54. In the illustrated embodiment, the cutting oxygen lever 38 opens the cutting oxygen valve assembly 54 when the cutting oxygen lever 38 is depressed. When the cutting oxygen valve assembly 54 is open, a path is created for cutting oxygen to flow through the torch butt 32 from the oxygen cylinder 28 to the cutting oxygen tube 46. When the cutting oxygen valve assembly 54 is closed, there is no path for cutting oxygen to flow through the torch butt 32. However, a path remains for pre-heat oxygen to flow through the torch butt 32.

The torch butt 32 is adapted to enable the cutting oxygen valve assembly 54 to be secured to the torch butt 32 in each of two orientations relative to the torch butt 32. Each orientation of the cutting oxygen valve assembly 54 is inverted 180 degrees relative to the other orientation. The first orientation enables the cutting oxygen lever 38 to operate the cutting oxygen valve assembly 54 from the top of the torch butt 32. The second orientation enables the cutting oxygen lever 38 to operate the cutting oxygen valve assembly 54 from the bottom of the torch butt 32. In the illustrated embodiment, the same torch butt 32, cutting oxygen lever 38, and cutting oxygen valve assembly 54 are used for each orientation of the cutting oxygen valve assembly 54 and cutting oxygen lever 38. The precise method of accomplishing the movement of cutting oxygen lever 38 and the cutting oxygen valve assembly 54 will be discussed in more detail below.

Figure 4:
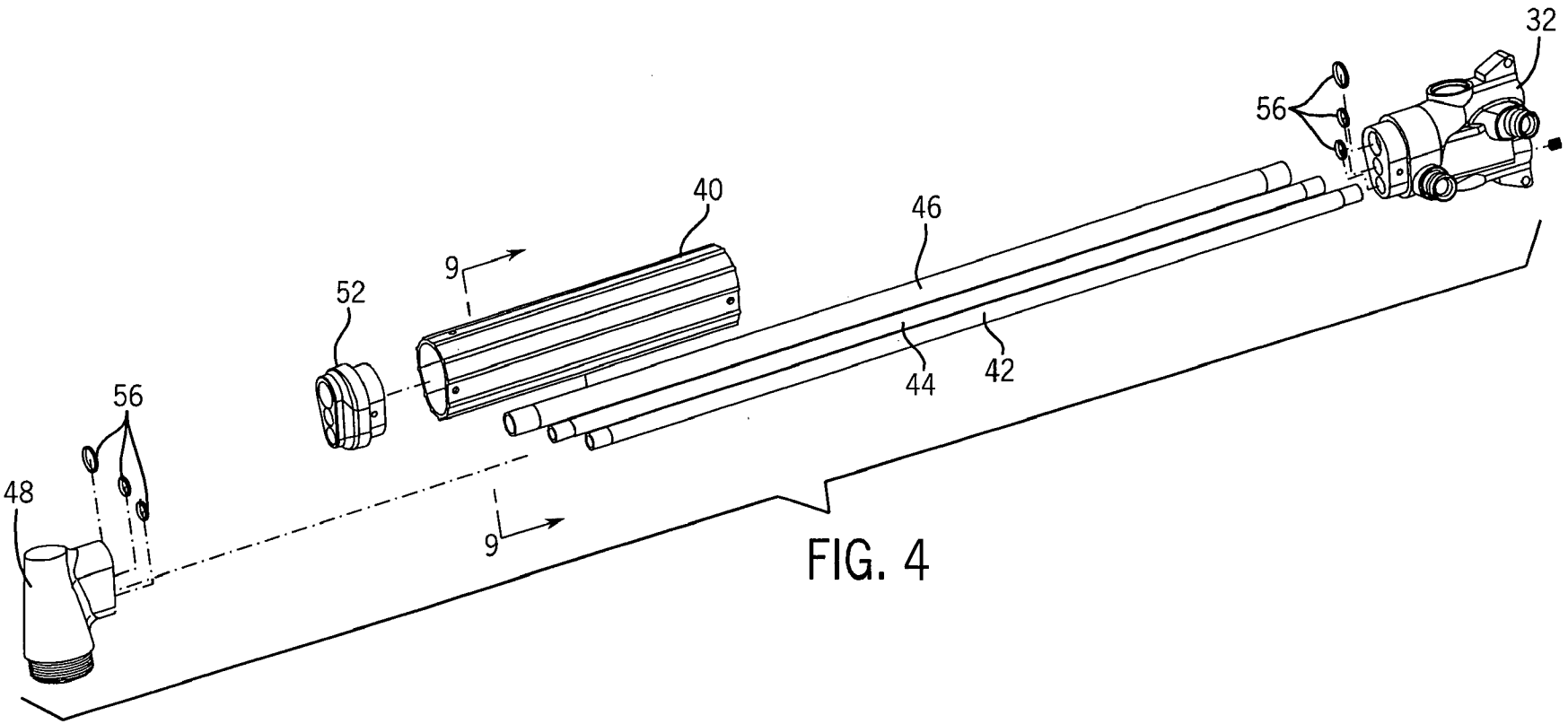
FIG. 4 is an exploded view of a portion of the torch of FIG. 1.

Referring generally to FIG. 4, an exploded view of a portion of the torch 22 is illustrated. As noted above, the torch head 48 is coupled to the fuel tube 42, the pre-heat oxygen tube 44, and the cutting oxygen tube 46. The torch head 48 merges the flows of fuel, pre-heat oxygen, and cutting oxygen and directs the merged flow toward the cutting tip 50. As noted above, the cutting tip 50 directs the fuel, pre-heat oxygen, and cutting oxygen from the torch 22 to produce a flame with desired characteristics for cutting. However, other contact tips may be used. The interface of the torch head 54 and the fuel and oxygen tubes 42, 44, and 46 and the interface of the torch butt 32 with the fuel and oxygen tubes 42, 44, and 46 are sealed with a plurality of silver brazing rings 56 to prevent leakage. The torch butt 32 and the tube support 58 are disposed within opposite ends of the torch handle 40 in the illustrated embodiment. The fuel tube 42, the preheat oxygen tube 44, and the cutting oxygen tube 46 pass through the tube support 52 and into the torch head 48.

Figure 5:
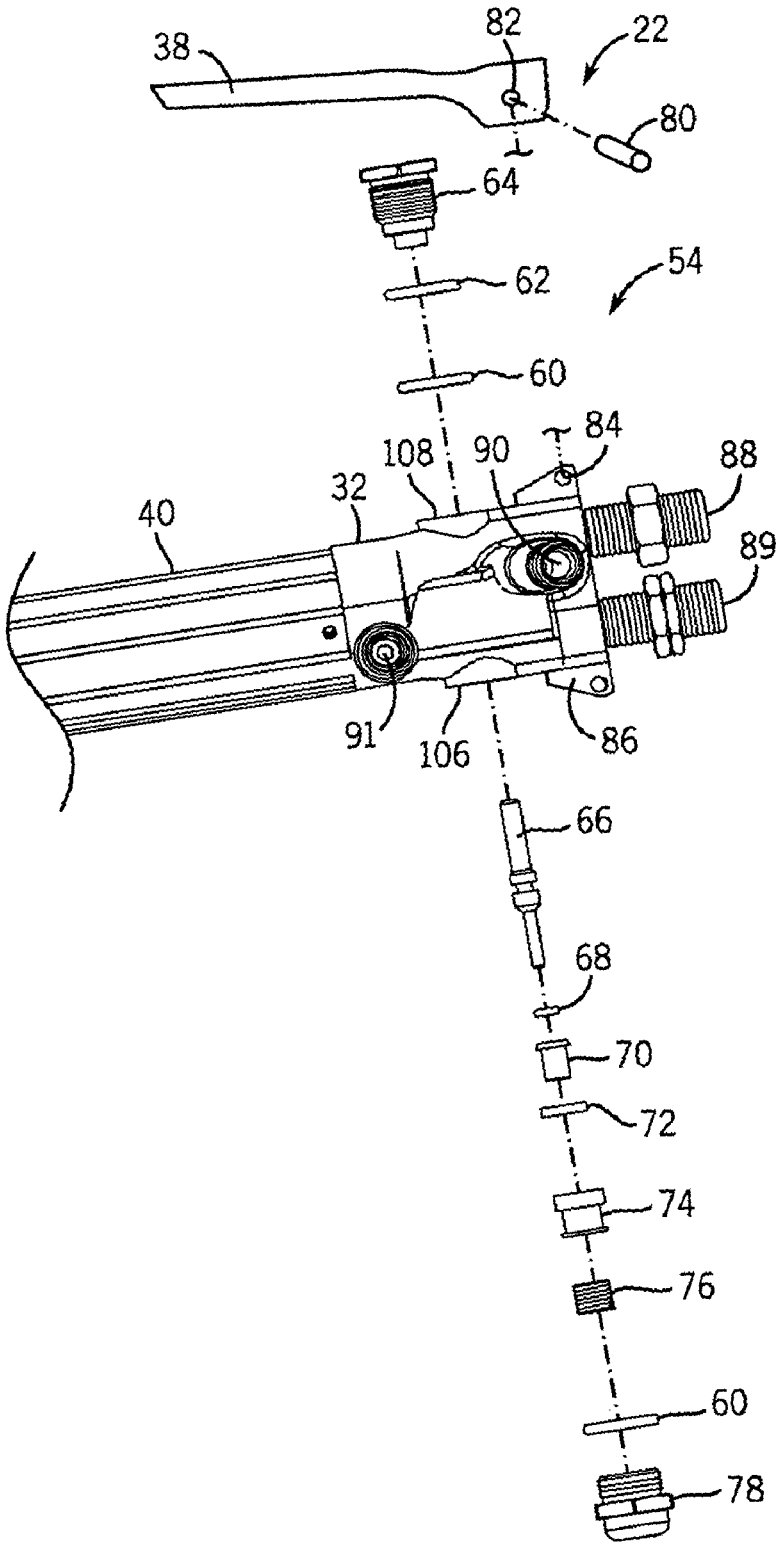
FIG. 5 is an exploded view of a portion of the torch of FIG. 3.
Figure 6:
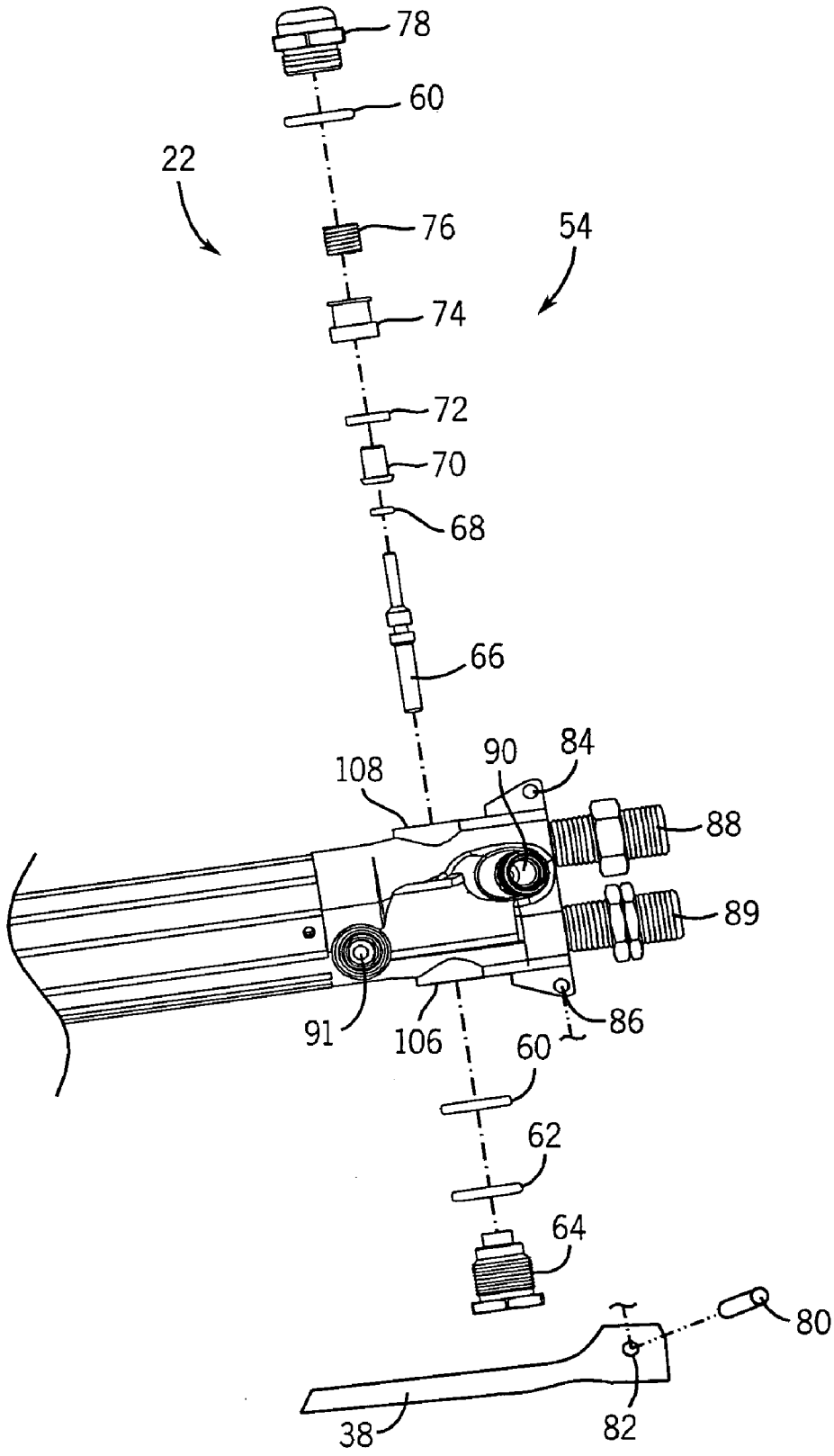
FIG. 6 is an exploded view of a portion of the torch of FIG. 3.

Turning now to FIGS. 5 and 6, the torch butt 32 is adapted to receive the cutting oxygen valve assembly 54 in each of two orientations so that the cutting oxygen lever 38 may be selectively located on either the top or the bottom of the torch butt 32. In the illustrated embodiment, the cutting oxygen valve assembly 54 comprises a pair of first o-rings 60, a second o-ring 62, a packing gland 64, a push rod 66, a third o-ring 68, a pin seat 70, a seat 72, a seat retainer 74, a spring 76, and a back cap 78. However, other components may be used. In FIG. 5, the cutting oxygen valve assembly 54 is disposed within the torch butt 32 in a first orientation relative to the torch butt 32 to enable the cutting oxygen lever 38 to be disposed on the top of the torch butt 32. In FIG. 6, the cutting oxygen valve assembly 54 is disposed within the torch butt 32 in a second orientation relative to the torch butt 32 to enable the cutting oxygen lever 38 to be positioned on the bottom of the torch butt 32.

To assemble the cutting oxygen valve assembly 54, the pair of first o-rings 60, the second o-ring 62, the push rod 66, the third o-ring 68, the pin seat 70, the seat 72, the seat retainer 74, and the spring 76 are disposed within the torch butt 32 and secured therein by the packing gland 64 and the back cap 78. The packing gland 64 and the back cap 78 are threaded into opposite sides of the torch butt 32 to capture the other cutting oxygen valve assembly 54 components therebetween. However, other methods may be used to secure the cutting oxygen valve assembly 54 to the torch butt 32. For example, the packing gland 64 and the back cap 78 may be held in place by separate fasteners, such as by a nut or a set screw. The pair of first o-rings 60, the second o-ring 62, the packing gland 64, the push rod 66, the third o-ring 68, the pin seat 70, the seat 72, the seat retainer 74, the spring 76, and the back cap 78 are oriented in a first direction relative to the torch butt in FIG. 5 and are oriented in a second, opposite direction relative to the torch butt 32 in FIG. 6. However, the same components are used in both orientations of the lever 38 and cutting oxygen valve assembly 54.

To disassemble the cutting oxygen valve assembly 54, cutting oxygen lever 38 is removed. Then, the packing gland 64 and the back cap 78 are unthreaded from the torch butt 32. This enables the pair of first o-rings 60, the second o-ring 62, the push rod 66, the third o-ring 68, the pin seat 70, the seat 72, the seat retainer 74, and the spring 76 to be removed from the passageway 92. The components of the cutting oxygen valve assembly 54 may then be inverted and reassembled within the torch butt 32 and secured therein by the packing gland 64 and the back cap 78.

The cutting oxygen lever 38 is pivotably secured to the rear of the torch butt 32 in the illustrated embodiment. A pivoting pin 80 is used to pivotably secure the handle 40 to the torch butt 32. However, other methods of pivotably securing the handle 40 to the torch butt 32 may be used. In FIG. 5, the pivoting pin 80 is disposed through a hole 82 located at the rear of cutting oxygen lever 38 and through a first hole 84 located on the top rear portion of the torch butt 32. In FIG. 6, the pivoting pin 80 is disposed through the hole 82 at the rear of the cutting oxygen lever 38 and through a second hole 86 on the bottom rear portion of the torch butt 32, the second hole 86 being opposite the first hole 82 about an axis through the torch butt 32.

In the illustrated embodiment, the torch 22 also comprises an oxygen check valve 88 and a fuel check valve 89. Pressurized oxygen from the oxygen cylinder 28 enters the torch butt 32 via the oxygen check valve 88. Similarly, fuel enters the torch butt 32 via the fuel check valve 89. The check valves 88, 89 prevent oxygen and fuel from flowing back through the torch 22 to the hoses 24, potentially causing a fire or explosion. In the illustrated embodiment, the oxygen check valve 88, the fuel check valve 89, the fuel throttle valve assembly 34, and the preheat oxygen throttle valve assembly 36 remain in the same orientation relative to the torch butt 34 regardless of the position of the cutting oxygen lever 38.

In the illustrated embodiment, the pre-heat oxygen flow path branches from the flow of the cutting oxygen 98 slightly downstream of the oxygen check valve 88. The torch butt 32 has a passageway for preheat oxygen to flow from just downstream of the oxygen check valve 88 to the preheat oxygen throttle valve assembly 36 illustrated in FIG. 2. The preheat oxygen throttle valve assembly 36 is disposed within a preheat oxygen throttle valve passageway 90 that extends into the torch butt 32. Similarly, the torch butt 32 has a fuel throttle valve passageway 91 that extends into the torch butt 32 to house the fuel throttle valve assembly 34 illustrated in FIG. 2.

Figure 7:
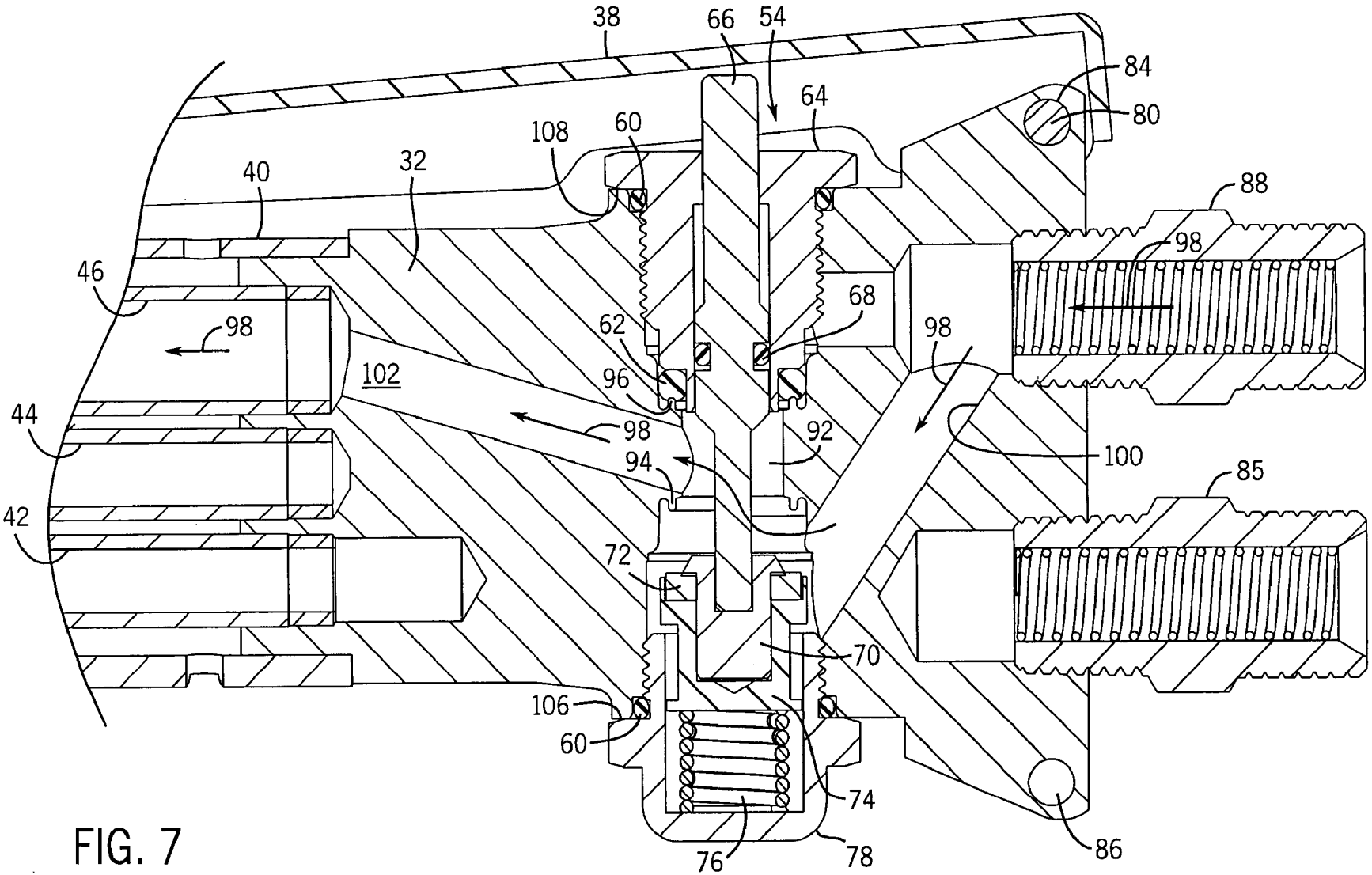
FIG. 7 is a cut-away view of a portion of the torch of FIG. 2.
Figure 8:
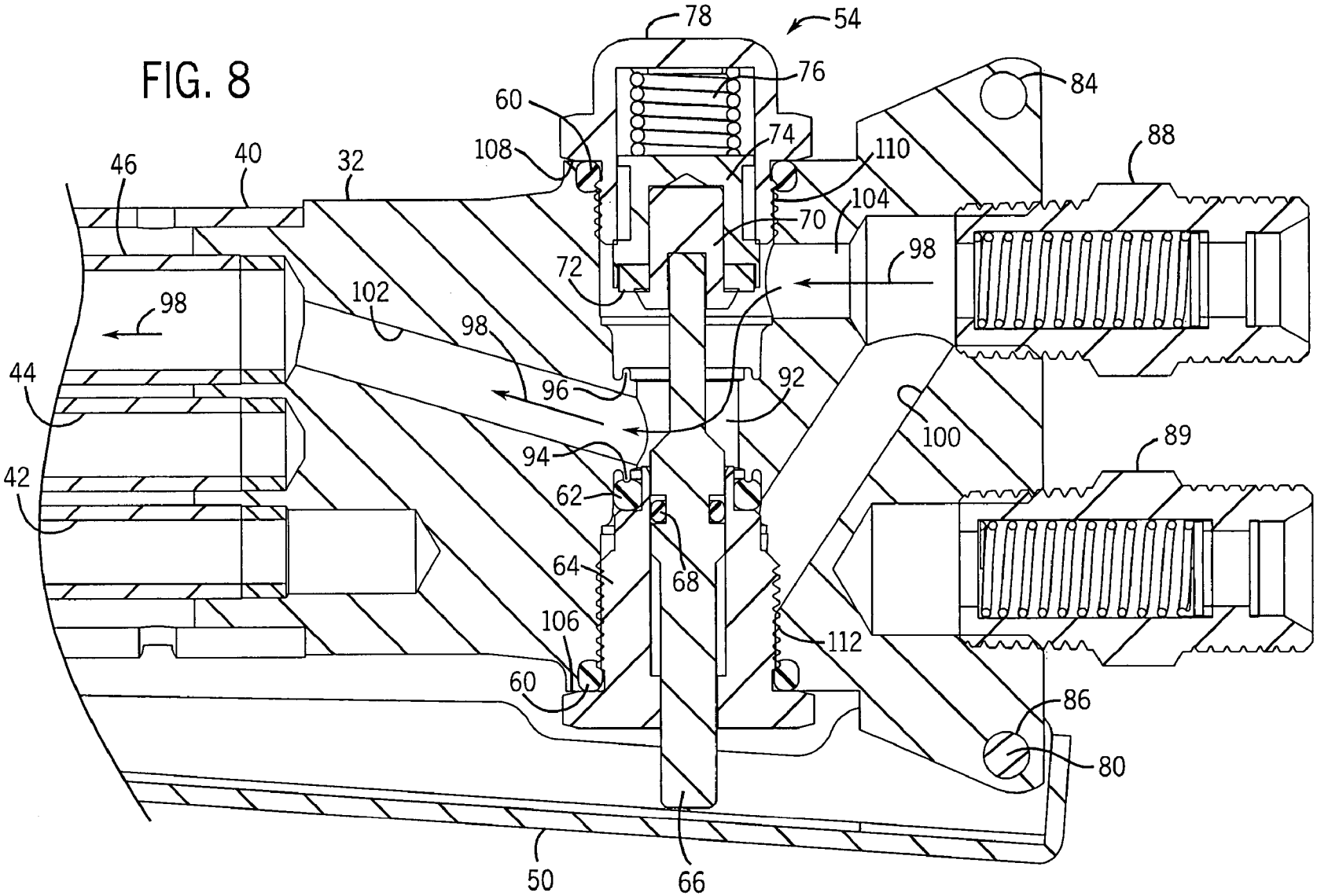
FIG. 8 is a cut-away view of a portion of the torch of FIG. 3.

Referring generally to FIGS. 7 and 8, the cutting oxygen valve assembly 54 is disposed within a cutting oxygen valve passageway 92 extending through the torch butt 32 from top to bottom. The passageway 92 is formed with a first seating surface 94 and a second seating surface 96. The first and second seating surfaces 94, 96 cooperate with the seat 72 of the cutting oxygen valve assembly 54 to control the flow of cutting oxygen through the torch butt 32. The seat 72 is seated against the first seating surface 94 to close the cutting oxygen valve assembly 54 when the cutting oxygen lever 38 is disposed on the top of the torch butt 32, as illustrated in FIG. 7. Conversely, the seat 72 is seated against the second seating surface 96 to close the cutting oxygen valve assembly 54 when the cutting oxygen lever 38 is disposed on the bottom of the torch butt 32, as illustrated in FIG. 8.

In FIG. 7, the cutting oxygen valve assembly 54 is illustrated in the open position to enable oxygen 98 to flow through the torch butt 32 to the cutting oxygen tube 46. Depressing the cutting oxygen lever 38 toward the torch handle drives the push rod 66 downward, in this view. The seat 72 is coupled to the pushrod 66 by the pin seat 70 and the seat retainer 74. The downward movement of the push rod 66 unseats the seat 72 from the first seating surface 94, enabling oxygen 98 to flow through a first passageway 100 to the cutting oxygen valve passageway 92. From the cutting oxygen valve passageway 92, oxygen 98 flows through a second passageway 102 to the cutting oxygen tube 46.

The cutting oxygen valve assembly 54 prevents oxygen from escaping out of the top and the bottom of the cutting oxygen valve passageway 92. The second o-ring 62, the packing gland 64, push rod 66, and the third o-ring 68 cooperate to seal one end of the passageway 92, while the back cap 78 seals the opposite end of the passageway 92. The second o-ring 62 is disposed against the second seating surface 96 by the packing gland 64 to form a seal between the packing gland 64 and the torch butt 32. The third o-ring 68 forms a seal between the push rod 66 and the packing gland 64.

The cutting oxygen valve assembly 54 is biased to return to the closed position. The downward movement of the cutting oxygen lever 38 drives the seat retainer 74 against the spring 76, compressing the spring 76. When the force depressing the cutting oxygen lever 38 is released, the spring 76 drives the seat retainer 74, the pin seat 70, and the seat 72 upward, in this view, causing the seat 72 to be seated against the first seating surface 94. When the seat 72 is seated against the first seating surface, oxygen 98 is blocked from flowing through the torch butt 32 to the cutting oxygen tube 46.

In FIG. 8, the cutting oxygen valve assembly 54 also is illustrated in the open position to enable oxygen 98 to flow through the torch butt 32 to the cutting oxygen tube 46. The orientation of the cutting oxygen valve assembly 54 in FIG. 8 is inverted from the orientation of the cutting oxygen valve assembly 54 in FIG. 7. The cutting oxygen valve assembly 38 is opened and closed in a manner similar to the manner described above in reference to FIG. 7. However, the seat 72 is seated against the second seating surface 96, not the first seating surface 94, to close the cutting oxygen valve assembly 54. To open the cutting oxygen valve assembly 54, the cutting oxygen lever 38 is depressed toward the handle 40. Depressing the lever 38 drives the push rod 66 upward, in this view, to unseat the seat 72 from the second seating surface 96. Unseating the seat 72 from the second seating surface 96 enables cutting oxygen 98 to flow through the torch butt 32 to the cutting oxygen tube 46.

In the illustrated embodiment, the cutting oxygen follows a different flow path through the torch butt 32 in FIG. 8 than in FIG. 7. In FIG. 8, when the seat 72 is unseated from the second seating surface 96, oxygen flows from the oxygen check valve 88 to the cutting oxygen valve passageway 92 through a third passageway 104, rather than through the first passageway 100. From the cutting oxygen valve passageway 92, the oxygen 98 flows through the second passageway 102 to the cutting oxygen tube 46.

Referring generally to FIGS. 7 and 8, as noted above, the torch butt 32 and the cutting oxygen valve assembly 54 are designed to enable the cutting oxygen valve assembly 54 to open and close a path for cutting oxygen to flow through the torch butt 32 in either of two orientations of the cutting oxygen valve assembly 54. For example, the cutting oxygen valve passageway 92 is generally symmetrical about the center of the passageway 92 so that the orientation of the cutting oxygen valve assembly 92 relative to the passageway 92 is irrelevant. For example, the distance of the first seating surface 94 from a bottom surface 106 of the torch butt 32 is the same as the distance of the second seating surface 96 from a top surface 108 of the torch butt 32. Thus, the seat 72 is disposed the same distance from the appropriate seating surface 94, 96 of the torch butt 32 when the back cap 78 is disposed against the bottom surface 106 as when the back cap 78 is disposed against the top surface 108 of the torch butt 32. In addition, the packing gland 64 and the second o-ring 62 are operable to form a seal against the opposite seating surface 96, 94 regardless of whether the packing gland 64 is disposed against the bottom surface 106 or the top surface 108 of the torch butt 32. In addition, the torch butt 32 has a top threaded portion 110 and a bottom threaded portion 112 that are designed to enable both the packing gland 66 and the back cap 78 to be threaded into both threaded portions 110, 112.

Thus, it is irrelevant to the operation of the cutting oxygen valve assembly 54 in which direction the cutting oxygen valve assembly 54 is oriented in the torch butt 32. In an alternate embodiment, the torch butt 32 may be adapted to have only one cutting oxygen flow path that flows to the center point of the cutting oxygen valve passage 92, through cutting oxygen valve assembly 54, and out of torch butt 32 into the cutting oxygen gas tube 46. The components of cutting oxygen valve assembly 38 would be such that the cutting oxygen valve assembly 38 is in the open position at the center of cutting oxygen valve passage 54. In this configuration the cutting oxygen valve assembly 54 would remain reversible so that the orientation of cutting oxygen valve assembly 54 could be modified to correspond with the orientation of cutting oxygen lever 38.

Figure 9:
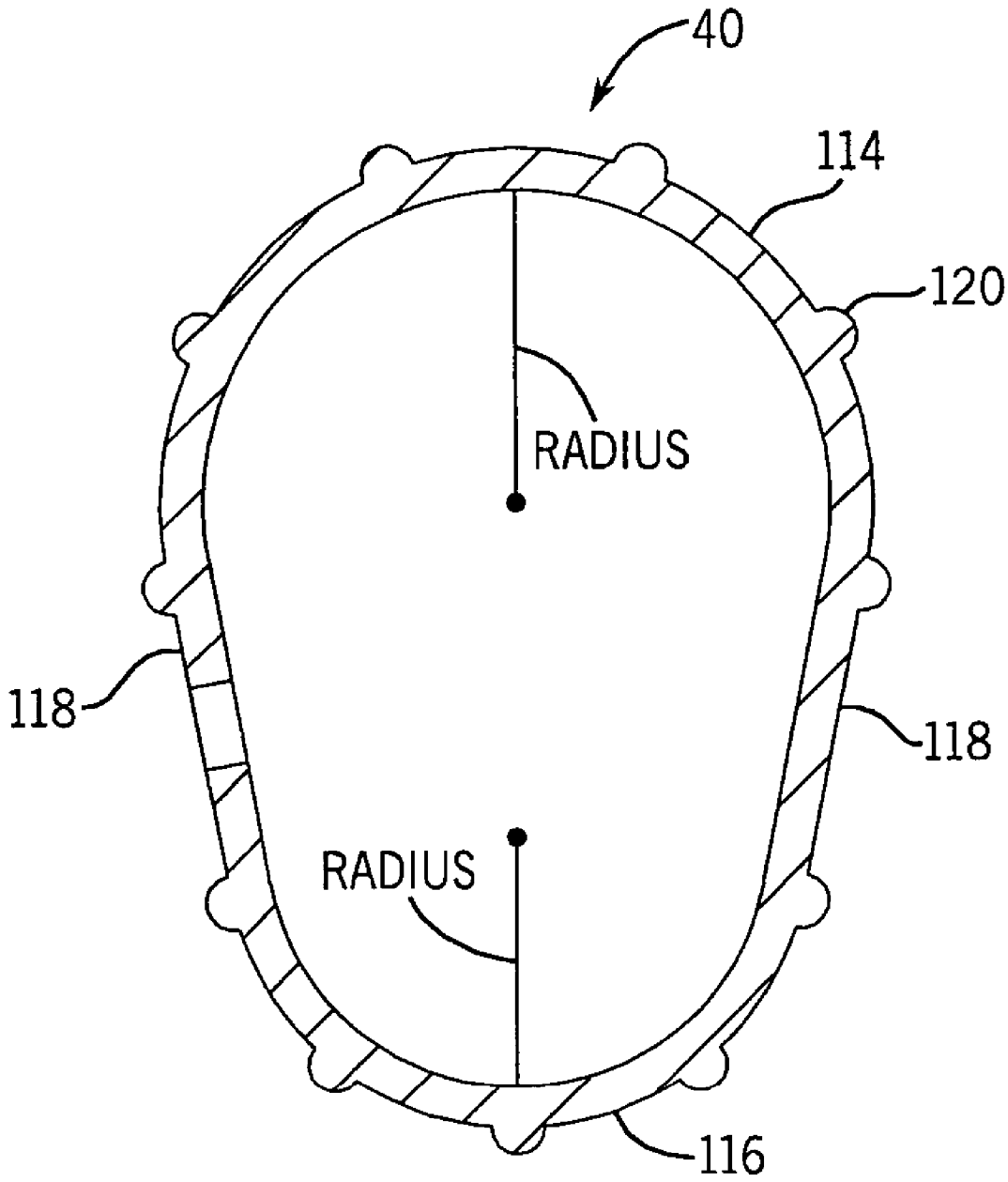
FIG. 9 is a cross-sectional view of a torch handle taken generally along line 9-9 of FIG. 4.

Referring generally to FIG. 9, a cross-section of torch handle 40. As illustrated in FIG. 9, the handle 40 has a "skull-shaped" cross-section. In the illustrated embodiment, the handle 40 has a curved top portion 114 and a curved bottom portion 116, with the radius of the curved top portion 114 being greater than the radius of the curved bottom portion 116. The handle 40 also has generally planar sides 118 that connect the curved top portion 114 and the curved bottom portion 116.

Referring again to FIG. 4, the cross-section of torch handle 40 remains constant over the entire length of the handle 40 in the illustrated embodiment. The "skull-shape" of torch handle 40 provides the operator with a more ergonomic grip than a cylindrical handle. To that end, the radius of the top portion 114 of the torch handle 40 is sized to properly fit the palm and thumb-forefinger arch of a heavily gloved hand while the radius of the bottom portion 116 of the torch handle 40 is sized to comfortably allow an operator to use their fingers to wrap around the handle 40. In the illustrated embodiment, the top portion 114 has a radius of approximately 0.5 inches and 0.6 inches and the bottom portion 116 has a radius of between 0.4 inches and 0.5 inches. The torch handle 40 also comprises a plurality of ribs 120. In the illustrated embodiment, the ribs 120 extend the entire length of the handle 40. Approximately 10 to 12 ribs 120 are disposed around the torch handle 40 in this embodiment. The ribs 124 provide a gripping surface for the operator. The ribs 124 are disposed around the handle 40 in such a way so as to provide a better gripping surface for a user where it is most desired, namely along the bottom of the torch handle 40 where there is less surface area for contact between the operators hand and the torch handle 40.

The illustrated embodiment described above, provides a torch 22 that may be selectively assembled with the cutting oxygen lever 38 on opposite sides of the torch 22. In addition, the same components are used in both configurations of the torch 22. Because the same components are used, an operator can reorient the cutting oxygen lever 32 in the field without any extra parts. The commonality of the parts is also advantageous from a manufacturing perspective because there are fewer parts to maintain in inventory and the manufacturing process can be streamlined because of the reduction in the total number of parts utilized. In addition, the preheat oxygen throttle valve assembly 36 and fuel throttle valve assembly 34 remain in the same orientation regardless of the orientation of the cutting oxygen lever 38.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A torch, comprising:

a valve assembly; and a torch butt comprising a passageway for receiving the valve assembly, and a passageway for routing fluid through the torch;

wherein the valve assembly is selectively securable to the torch butt in a first orientation and a second orientation relative to the torch butt, the second orientation being inverted relative to the first orientation, the valve assembly being operable to control the fluid to the passageway in both the first and second orientations; and wherein the torch butt comprises first and second intakes, such that the valve assembly receives the fluid from the first intake when in the first orientation and from the second intake when in the second orientation.

2. The torch as recited in claim 1, wherein the passageway defines a first seating surface and a second seating surface for sealing engagement with the valve assembly, the first and second seating surfaces being oriented in opposite directions.

3. The torch as recited in claim 1, comprising a first portion and a second portion, wherein the first and second portions are operable to pivotally secure a valve-operating lever to the torch butt, wherein the first portion and the second portion are disposed on opposite rear positions of the torch butt.

4. The torch as recited in claim 3, wherein the valve assembly is oriented in the first orientation to enable the valve-operating lever to operate the valve assembly when secured to the first portion of the torch butt.

5. The torch as recited in claim 4, wherein the valve assembly is oriented in the second orientation to enable the valve-operating lever to operate the valve assembly when secured to the second portion of the torch butt.

6. The torch as recited in claim 3, wherein the first portion and the second portion comprise a hole in the torch member.

7. A torch, comprising:

means for selectively securing a cutting oxygen valve assembly within a torch butt in a first and a second orientation relative to the torch to provide a fluid flow to a dedicated passage from first and second intakes, the second orientation being inverted relative to the first orientation, and wherein the cutting oxygen valve assembly receives the fluid flow from the first intake when in the first orientation and the second intake when in the second orientation; and means for pivotally securing a lever on opposite sides of the torch to enable the lever to operate the cutting oxygen valve assembly in the first and the second orientation.

8. A system, comprising:

a torch, comprising:

a combustion tip;

a body coupled to the combustion tip, wherein the body comprises first and second pivot joints disposed on opposite sides of the torch and separate from one another;

a fuel inlet coupled to the body upstream from the combustion tip;

an oxygen inlet coupled to the body upstream from the combustion tip;

a valve passage extending crosswise completely through the body in a crosswise direction relative to a longitudinal axis of the torch;

a reversible valve member disposed in the valve passage and movable in the crosswise direction, wherein the reversible valve member comprises first and second valve orientations that are reversible relative to opposite ends of the valve passage on the opposite sides of the torch, respectively; and a lever comprising first and second mounting orientations that are reversible relative to the opposite ends of the valve passage while the body remains in a fixed position relative to the combustion tip, wherein the first mounting orientation comprises the lever mutually exclusively secured to the first pivot joint without connection to the second pivot joint, and the second mounting orientation comprises the lever mutually exclusively secured to the second pivot joint without connection to the first pivot joint.

9. The system of claim 8, wherein the lever directly engages the reversible valve member.

10. The system of claim 8, wherein the lever interfaces with the reversible valve member at a position outside of the body.

11. The system of claim 8, wherein the reversible valve member is configured to open and close a first flow path but not a second flow path while movable in the first valve orientation, and the reversible valve member is configured to open and close the second flow path but not the first flow path while movable in the second valve orientation.

12. The system of claim 11, wherein the first flow path comprises a first inlet passage and the second flow path comprises a second inlet passage separate from the first inlet passage.

13. The system of claim 8, wherein the lever is disposed at least substantially outside the body in an accessible position.

14. A system, comprising:

a torch valve body comprising a valve passage extending completely through the torch valve body along a first axis crosswise to a second axis, wherein the second axis is oriented in a general direction of fluid flow though the torch valve body;

a valve movable along the first axis within the valve passage, wherein a portion of the valve that moves along the first axis protrudes from the torch valve body to an engagement position outside of the torch valve body, and the valve is selectively mountable in the valve passage in a first orientation and a second orientation inverted relative to the first orientation;

a first oxygen pathway controlled by the valve;

a second oxygen pathway bypassing and not controlled by the valve;

a fuel pathway bypassing and not controlled by the valve; and a lever engaged with the portion of the valve at the engagement position, wherein the lever is selectively mountable to the torch valve body in a first lever orientation and a second lever orientation inverted relative to the first lever orientation.

15. The system of claim 14, wherein the lever is reversible between the first and second lever orientations while the torch valve body remains in a fixed position.

16. The system of claim 14, comprising first and second pivot joints disposed on opposite sides of the torch valve body and separate from one another, wherein the first lever orientation comprises the lever mutually exclusively secured to the first pivot joint without connection to the second pivot joint, and the second lever orientation comprises the lever mutually exclusively secured to the second pivot joint without connection to the first pivot joint.

17. The system of claim 14, comprising a torch having the torch valve body, the valve, and the lever.

18. The system of claim 14, comprising a handle coupleable to the torch valve body, wherein the handle has a skull-shaped cross section uniform along a length of the handle.

19. The system of claim 14, comprising a handle coupleable to the torch valve body, wherein the handle has an upper radius and a lower radius that are uniform along a length of the handle, and the upper and lower radii are different from one another.

20. A system, comprising:

a torch, comprising:

a body comprising a valve passage having an axis oriented crosswise relative to a longitudinal axis of the torch; and a valve disposed in the valve passage, wherein the valve has a range of movement along the axis in opposite directions oriented crosswise relative to the longitudinal axis of the torch, and the valve is selectively mountable in the valve passage in a first orientation and a second orientation inverted relative to the first orientation;

wherein the valve passage is coupled to a first fluid inlet, a second fluid inlet, and a fluid outlet, wherein the valve receives fluid from the first fluid inlet when in the first orientation and from the second fluid inlet when in the second orientation, and the valve outputs the fluid to the fluid outlet in both the first and second orientations.

21. The system of claim 20, comprising a lever selectively mountable to the body in a first lever orientation and a second lever orientation inverted relative to the first lever orientation.

22. The system of claim 21, wherein the lever is reversible between the first and second lever orientations while the body remains in a fixed position.

23. The system of claim 20, comprising a push rod coupled to the valve and extending outside an exterior of the body, wherein the push rod is movable along the axis in the opposite directions with the valve.

24. The system of claim 20, comprising a torch head coupled to the body, wherein the body is rotationally fixed relative to the torch head.

25. The system of claim 20, wherein the body comprises a single fluid outlet coupled to the valve passage.

26. A system, comprising:

a torch, comprising:

a body comprising a valve passage;

a valve selectively mountable in the valve passage in a first orientation and a second orientation inverted relative to the first orientation, wherein the valve passage is coupled to a first fluid inlet, a second fluid inlet, and a fluid outlet, wherein the valve receives fluid from the first fluid inlet when in the first orientation and from the second fluid inlet when in the second orientation, and the valve outputs the fluid to the fluid outlet in both the first and second orientations;

a first pivot joint;

a second pivot joint; and a lever selectively mountable to the torch in a first lever orientation and a second lever orientation inverted relative to the first orientation, wherein the first lever orientation comprises the lever mutually exclusively secured to the first pivot joint without connection to the second pivot joint, and the second lever orientation comprises the lever mutually exclusively secured to the second pivot joint without connection to the first pivot joint.

27. The system of claim 26, wherein the lever is reversible between the first and second lever orientations while the body remains in a fixed position.

28. A system, comprising:

a torch, comprising:

a body comprising a valve passage having an axis oriented crosswise relative to a longitudinal axis of the torch; and a valve disposed in the valve passage, wherein the valve has a range of movement along the axis in opposite directions oriented crosswise relative to the longitudinal axis of the torch, and the valve is selectively mountable in the valve passage in a first orientation and a second orientation inverted relative to the first orientation, wherein the torch splits flow of a fluid to partially bypass the valve and to be partially controlled by the valve.

29. The system of claim 28, comprising a lever reversibly mountable to the torch between first and second lever orientations while the body remains in a fixed position.

* * * * *